United States Patent [19]

Meyer et al.

[11] 4,192,690

[45] Mar. 11, 1980

[54] FIBER-REINFORCED HYDRAULICALLY HARDENABLE SHAPED OBJECTS

[75] Inventors: Adolf Meyer, Leimen bein Heidelberg; Peter O. Gutfleisch, Mannheim, both of Fed. Rep. of Germany

[73] Assignee: Portland-Zementwerke Heidelberg A.G., Heidelberg, Fed. Rep. of Germany

[21] Appl. No.: 790,763

[22] Filed: Apr. 25, 1977

[30] Foreign Application Priority Data

Apr. 23, 1976 [DE] Fed. Rep. of Germany ..... 2617741

[51] Int. Cl.[2] ..... B28B 21/44; B28B 21/56

[52] U.S. Cl. ..... 106/99; 264/115; 264/309; 264/349; 264/DIG. 72; 425/202

[58] Field of Search ..... 264/115, 299, 309, 349, 264/DIG. 72; 366/27; 106/99; 425/202

[56] References Cited

U.S. PATENT DOCUMENTS

| | | | |
|---|---|---|---|
| 1,346,638 | 7/1920 | Crook | 264/DIG. 72 |
| 3,289,371 | 12/1966 | Pearson | 264/309 X |
| 3,972,972 | 8/1976 | Yano | 264/333 X |

FOREIGN PATENT DOCUMENTS

| | | | |
|---|---|---|---|
| 1360803 | 7/1974 | United Kingdom | 264/DIG. 72 |

*Primary Examiner*—Thomas P. Pavelko
*Attorney, Agent, or Firm*—Michael Klotz

[57] ABSTRACT

The invention relates to a process for the preparation of fiber-reinforced cement-based hydraulically hardenable shaped objects, which comprises spraying matrix and fibers with a spraying apparatus onto a deflecting surface to produce a mixture of matrix and fibers, removing the mixture in the unhardened state from the deflecting surface into a mould, and preparing from the mixture fiber-reinforced cement-based hydraulically hardenable shaped objects.

The invention further relates to an apparatus for the preparation of the above described shaped objects.

13 Claims, 1 Drawing Figure

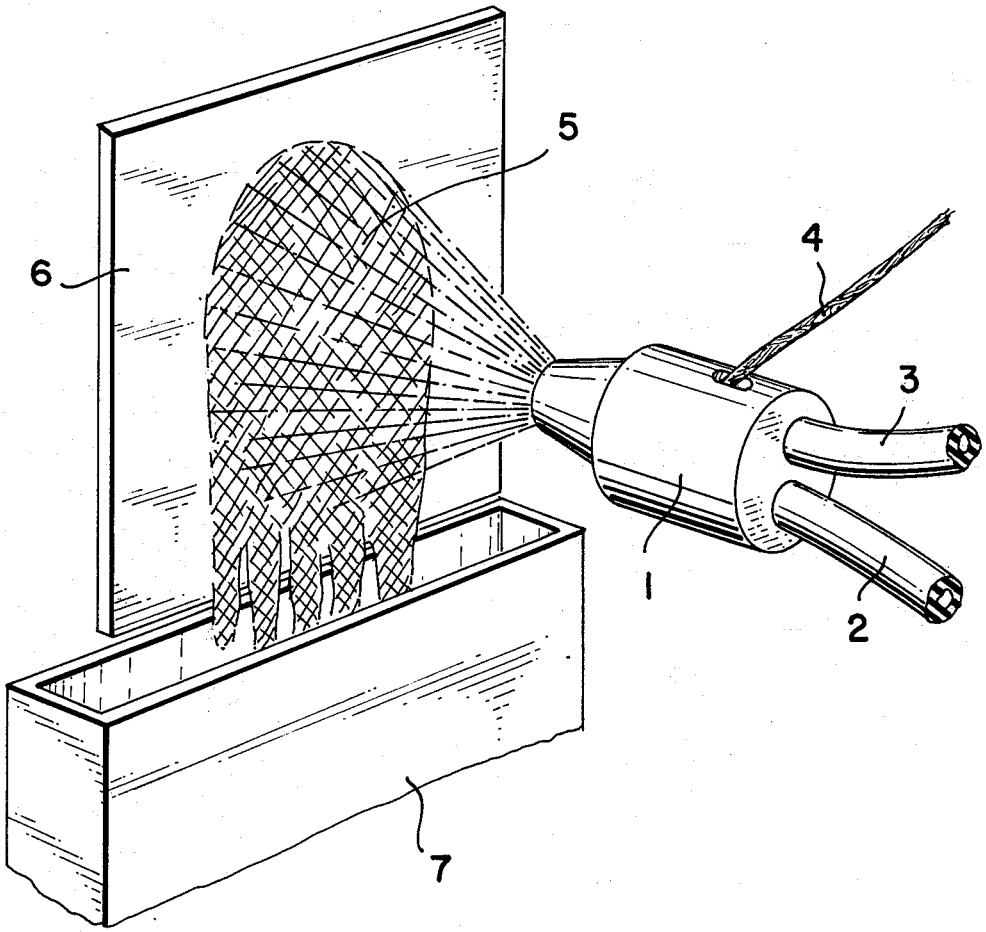
5
6
4
3
1
2
7

FIBER-REINFORCED HYDRAULICALLY HARDENABLE SHAPED OBJECTS

This invention relates to the preparation of cement-based hydraulically hardenable shaped objects or shaped forms for use in construction and, in particular, to a process and apparatus for the preparation of fiber-reinforced cement-based hydraulically hardenable shaped objects or forms.

The construction industry has made of late increasing use of hydraulically hardened substances which are reinforced by the addition to the mass of mineral, synthetic or natural fibers. Hydraulically hardenable substances, that is to say substances setting or hardening under water, characteristically exhibit brittleness. The addition of the fibers makes the substances less brittle and tougher. They can then be used as the material to form thin-walled or complex-shaped building structures.

However, the building structures or shaped objects or forms should advantageously be made from the substances in the unhardened state as they can then be shaped as desired or poured into narrow and complex moulds, and experience has shown that the mineral, synthetic or natural fibers could not be simply added to or mixed with the unhardened substances because of the weak consistency of the fibers.

Attempts have been made in the construction industry to overcome this difficulty by first preparing a felt or a mixture of the fibers and the matrix or mortar and promptly using the felt or mixture on the construction site by directly spraying it onto the surface of the shaped object to be built up layer by layer. However, it has not been feasible to obtain a good mixture of fibers and matrix in this way for use in making the shaped object or form and the mixture also had a tendency to prematurely harden and could not be satisfactorily handled as a fluid.

It is an object of the invention to overcome these and and other disadvantages and to provide a process and apparatus which would make possible the preparation of highly satisfactory shaped objects or forms for use in the construction industry.

It is a further object of the invention to prepare such shaped objects or forms from materials which need not be made directly at the construction site but which can be transported to the site as convenient.

It is a further object of the invention to prepare and to use in the mixture with the matrix oriented fibers which give high strength to the shaped objects or forms.

These and other objects are achieved by the process and apparatus of the invention which broadly comprises the use of deflecting surface, plate, wall, board, conical or circular vessel or the like onto which the matrix or mortar and the fibers are sprayed and from which the mixture of mortar so formed is allowed to run off or flow off or from which it can be scraped off, spun off or removed by other suitable means.

In particular, the invention provides a process for the preparation of fiber-reinforced cement-based hydraulically hardenable shaped objects, which comprises spraying matrix and fibers with a spraying apparatus onto a deflecting surface to produce a mixture of matrix and fibers, removing the mixture in the unhardened state from the deflecting surface into a mould or a suitable receptacle, and preparing from the mixture the shaped objects.

The invention further provides an apparatus for the preparation of the above defined shaped objects, which comprises a deflecting surface, means for spraying matrix and fibers onto the deflecting surface to produce a mixture of matrix and fibers, means for collecting the mixture in the unhardened state from the deflecting surface, and means for shaping the mixture to form the shaped objects or shaped forms.

The matrix or mortar for use in the process and apparatus of the invention is preferably highly fluid. It can advantageously be made more fluid by the addition of useful liquefying agents, most commonly water. Polyethylene oxide or methyl cellulose may also be added with advantage in order to lessen the propensity of hydraulically hardened substances to resist or repel water. Other additives may also be used, for example susbtances which increase air porosity. Suitable additives include "Vinsol" resin, lignin sulfates or melamine resin. "Vinsol" is the trade name for a dark-colored, hard, pine resin.

The fibers for use in the invention include mineral, synthetic and natural fibers, such as glass fiber, mineral wool, slag wool, synthetic rayons and synthetic polymer fibers including polyesters, cellulosic fibers and wool and silk. Suitable fibers will be chosen with the consideration of cost and the physical properties to be imparted to the mixture with the matrix or mortar and to the shaped objects or forms made therefrom. Glass fiber is highly advantageous for the purpose of the invention for the reason of both low cost and satisfactory properties imparted.

In accordance with a preferred embodiment of the invention the fibers can be straightened out or oriented on their passage onto the deflecting surface in order to add strength to the shaped objects or forms produced by the invention. In accordance with one aspect of the invention, orientation may be imparted to the fibers by the use of guides or screens when the fibers are sprayed onto the deflecting surface. In accordance with another aspect of the invention, orientation may be imparted to the fibers by providing separate spraying heads in the spraying apparatus for the fibers and the matrix, the spraying heads being rotatable, and using the relative motion of the spraying heads to impart orientation.

The fibers are preferably supplied to the spraying apparatus in the form of a slightly twisted roll or strand of fibers, intermediate between a sliver and yarn, known as a roving.

The deflecting surface can be in the shape of a plate, a wall or a plate board. It can also be in the shape of a cone or funnel or in the form of a circular vessel, such as a bucket or the like. The deflecting surface may be swingeable or rotatable or it may be inclined with respect to the vertical in such a way that the vertical axis of the deflecting surface may form an acute or an obtuse angle with the line of spray. It may further be upright or vertical. The deflecting surface and the spraying apparatus may form a single unit. The deflecting surface may also form a single unit with the mould, form or other receptacle for the mixture of fibers and matrix or mortar.

The fibers and the matrix or mortar may be sprayed onto the deflecting surface with the aid of compressed air supplied to the spraying apparatus. If the matrix is suitably fluid and if the deflecting plate is placed close to the outlet of the spraying apparatus, the fibers and the matrix may also be sprayed onto the deflecting surface without the aid of compressed air in a so-called "airless" process.

The apparatus of the invention will now be illustrated by means of the accompanying drawing which shows the embodiment in which the deflecting surface is vertical and separate from the spraying apparatus and from the mould and in which the fibers and the matrix or mortar are sprayed onto the deflecting surface with compressed air. It is understood that the drawing is illustrative only and that the invention is not to be limited except as defined in the appended claims.

In the drawing, 1 is a spraying apparatus with a cutting device (not shown), 2 is the lead or hose for supplying to the spraying apparatus mortar of suitable consistency together with appropriate additives, 3 is the lead or hose for supplying to the spraying apparatus compressed air. 4 is a roving of glass fibers, 5 is the mixture of mortar and fibers sprayed onto the deflecting plate 6. 6 is the deflecting surface in the form of a vertical plate or board and 7 is the mould into which the mixture 5 runs off, drips off or flows off.

It will be understood that the mortar may be supplied to the spraying apparatus other than by a hose or lead, for example from a container, bucket or similar. Compressed air may be supplied through other than a permanently attached hose or lead, for example intermittently. The fibers may be supplied through other than the roving, for example suitable fibers may be pre-cut, if desired. The deflecting surface, plate, wall or board 6 is shown in the illustrative drawing as vertical, but it may also be inclined to the vertical to form any acute or obtuse angle desired. However, an angle larger than 5° or smaller than 175° is preferred in practical operation. The mould or form may be of any shape desired and its width, length or height may be of any dimension suitable for use in construction. The apparatus may be used to fill a single mould or form or a series of moulds or forms, partially or completely. The filled moulds or forms may be used in any configuration needed.

The invention will now be illustrated by means of the following Examples which show the various embodiments. However, it is understood that the invention is not limited thereby except as defined in the appended claims.

EXAMPLE 1

A cleaning or scouring machine, also used for fine plastering, was used as the spraying apparatus. The spraying apparatus consisted of two spraying heads, mounted together at a distance of 20 cm from a deflecting plate, made from a steel plate 0.5 mm thick. The deflecting plate measured 25 by 25 cm and was inclined to form an angle of 25° between its vertical axis and the direction of the spray. The spray areas from the two spraying heads for spraying fibers and mortar were made to coincide on the deflecting plate.

An alkali-resistant glass fiber in the form of a roving was used as the fiber. Highly fluid Portland cement was used as the matrix. The composition of the matrix was as follows:

Portland cement (brand designated as PZ350)—1020 kg/m$^3$
water—530 kg/m$^3$
fluid sand (granule size less than 0.5 mm—230 kg
crushed rock feed—45 kg
high performance liquefying agent (based on melamine resin)—15.3 kg
polyethylene oxide—0.34 kg
glass fiber—83.5 kg The mixture of fibers and matrix was sprayed onto the deflecting plate from which it drained off directly into an open mould 12 mm wide across the opening and 3 m high. No evidence of compression and no clogging or fiber accumulation was observed.

EXAMPLE 2

The spraying apparatus described in Example 1 was used to spray the same matrix and the same fiber into a hollow cone having an upper diameter of 25 cm, a lower diameter of 12 mm and a height of 35 cm. However, polyethylene in the matrix was replaced by 0.66 kg of methyl cellulose per m$^3$ of the finished matrix.

The spraying head for the matrix was fitted with a fine spray nozzle and the matrix was sprayed with a pump instead of with compressed air. Fine separation of the matrix took place and a gap 3 m high was satisfactorily filled.

The use of an air pump in place of compressed air is of considerable economic advantage and it also makes for better work conditions as the formation of dust, common when using compressed air with matrix, is avoided.

EXAMPLE 3

The spraying apparatus described in Example 1 was used to spray the same matrix and the same fiber into a circular bucket provided with a spout. A homogenous mixture was obtained in the bucket which was then poured into an opening between two form plates by means of a filling funnel.

This variant of the process is of particular economic advantage. Cut glass fiber for use in a conventional cement mixing process costs approximately $3.80 a kg. The glass fiber which can be used in the process of the invention costs only $3.40 a kg. Considering only the price difference between the fibers used, one achieves a price advantage of $31 per m$^3$ of matrix.

EXAMPLE 4

The mixture of fibers and mortar described in Example 1 was allowed to drip off the deflecting plate down an inclined board, 1 m wide and inclined less than 60°. The friction between the inclined board and the matrix and fiber imparted orientation to the fiber. The dripped off mixture was then collected onto a slab or plate on the surface of which it hardened.

EXAMPLE 5

The matrix and fibers described in Example 1 were sprayed from a spraying head attached to a fixed wall, separate spraying heads being used for spraying the matrix and the fibers. A highly fluid matrix was used. Orientation was imparted to the fibers, resulting in a hardened shaped object in which the fibers were incorporated.

The process of this Example was repeated to form a window element 7 m long. The deflecting surface was in the form of a wall made of plastic-coated wood. Spraying heads were used with a velocity of 0.5 m per second. The resulting orientation of the fibers produced a fiber-reinforced window element having a strength 1.8 higher than the strength of a similar element made by the conventional cement mixing process, using added cut fibers.

EXAMPLE 6

A fiber-reinforced hardenable material was prepared using the process described in Example 3 and, for comparison purposes, fiber-reinforced material was also prepared using a conventional cement mixing process. Tests specimens measuring 33 by 6 by 3 cm were made from both materials and were subjected to a bending test after submersion under water for 7 days. The results were as follows

| Process | Bending stress resistance kp/cm$^2$ | | | | | | Average | % |
|---|---|---|---|---|---|---|---|---|
| Conventional mixing | 181, | 174, | 171, | 179, | 173, | 176 | 175 | 100% |
| Process of invention | 222, | 219, | 198, | 224, | 218, | 221 | 217 | 124% |

In addition to its many economic advantages and the higher strength of shaped objects obtained, the invention makes possible very careful handling of the fibers as no mixing in the usual sense takes place. Fibers can therefore be used in the invention which are sensitive to mechanical treatment. The invention also makes it possible to use a lower water excess in the matrix.

Numerous modifications and variations of the invention are possible in the light of the above teachings and, therefore, within the scope of the appended claims, the invention may be practiced other than as particularly described.

What is claimed is:

1. Process for the preparation of fiber-reinforced cement-based hydraulically hardenable shaped objects, which comprises spraying cement-based matrix and fibers with a spraying apparatus onto a deflecting surface to produce on said surface a mixture of matrix and fibers, removing the mixture in the unhardened state from said deflecting surface into a mould, and moulding from the mixture fiber-reinforced cement-based hydraulically hardenable shaped objects by hardening under water.

2. The process claimed in claim 1, in which the deflecting surface is selected from the group comprising a plate, a wall and a board.

3. The process claimed in claim 1, in which the deflecting surface is in the shape of a funnel.

4. The process claimed in claim 1, in which the vertical axis of the deflecting surface forms an acute angle with the line of spray.

5. The process claimed in claim 1, in which the vertical axis of the deflecting surface forms an obtuse angle with the line of spray.

6. The process claimed in claim 1, in which the matrix and the fibers are sprayed onto the deflecting surface with compressed air.

7. The process claimed in claim 1, in which the matrix comprises in addition a liquefying agent.

8. The process claimed in claim 1, in which the matrix comprises in addition melamin resin.

9. The process claimed in claim 1, in which the matrix comprises in addition polyethylene oxide.

10. The process claimed in claim 1, in which the matrix comprises in addition methylcellulose.

11. The process claimed in claim 1, in which the matrix and the fibers are sprayed without the aid of compressed air.

12. The process claimed in claim 1, in which the deflecting surface is swingeable or rotatable.

13. Fiber-reinforced cement-based hydraulically hardenable shaped objects prepared by the process of claim 1.

* * * * *